US011717951B2

(12) United States Patent
Hyma et al.

(10) Patent No.: US 11,717,951 B2
(45) **Date of Patent: *Aug. 8, 2023**

(54) SCREWDRIVER

(71) Applicant: Milwaukee Electric Tool Corporation, Brookfield, WI (US)

(72) Inventors: Steven W. Hyma, Milwaukee, WI (US); Joseph M. DeBaker, Greenfield, WI (US); Kyle C. Anderson, Wauwatosa, WI (US); Aaron S. Blumenthal, Shorewood, WI (US); Mark W. Cors, St. Francis, WI (US); Christopher S. Hoppe, Wisconsin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 50 days.

This patent is subject to a terminal disclaimer.

(21) Appl. No.: 17/341,037

(22) Filed: Jun. 7, 2021

(65) Prior Publication Data

US 2021/0291348 A1 Sep. 23, 2021

Related U.S. Application Data

(63) Continuation of application No. 15/980,802, filed on May 16, 2018, now Pat. No. 11,059,162.

(60) Provisional application No. 62/509,241, filed on May 22, 2017, provisional application No. 62/507,314, filed on May 17, 2017.

(51) Int. Cl.

| | |
|---|---|
| ***B25G 1/10*** | (2006.01) |
| ***B25B 15/02*** | (2006.01) |
| ***B25B 23/16*** | (2006.01) |
| ***B25G 1/00*** | (2006.01) |
| ***B25B 15/00*** | (2006.01) |
| *B25B 23/00* | (2006.01) |

(52) U.S. Cl.

CPC ..... *B25G 1/102* (2013.01); *B25B 15/004* (2013.01); *B25B 15/02* (2013.01); *B25B 23/16* (2013.01); *B25G 1/005* (2013.01); *B25G 1/105* (2013.01); *B25B 15/005* (2013.01); *B25B 15/007* (2013.01); *B25B 23/0042* (2013.01)

(58) Field of Classification Search

None

See application file for complete search history.

(56) References Cited

U.S. PATENT DOCUMENTS

| | | | |
|---|---|---|---|
| 1,541,078 | A | 6/1925 | Sudweeks |
| 1,738,405 | A | 12/1929 | Thal |
| 1,741,349 | A | 12/1929 | Sullivan |

(Continued)

FOREIGN PATENT DOCUMENTS

| | | |
|---|---|---|
| CN | 2209023 | 10/1995 |
| CN | 3126913 | 11/1999 |

(Continued)

*Primary Examiner* — Brian D Keller

(74) *Attorney, Agent, or Firm* — Reinhart Boerner Van Deuren s.c.

(57) ABSTRACT

A screwdriver comprises a handle including a butt and a shank extending from the handle and including a tip. The butt includes a first indicating element having a shape corresponding to the tip and a plurality of second indicating elements arranged around the first indicating element. Each of the second indicating elements has the shape.

19 Claims, 8 Drawing Sheets

(56) References Cited

U.S. PATENT DOCUMENTS

| | | | | |
|---|---|---|---|---|
| 1,782,981 | A | 11/1930 | Anderson | |
| 1,899,489 | A | 2/1933 | Wickbergh | |
| 2,609,851 | A | 9/1952 | Hadfield | |
| 3,133,568 | A | 5/1964 | Reed | |
| 3,211,199 | A | 10/1965 | Reed | |
| 3,393,722 | A | 7/1968 | Windham | |
| 3,616,827 | A | 11/1971 | Stillwagon, Jr. | |
| 3,656,522 | A | 4/1972 | Ingimarsson | |
| 4,404,749 | A | 9/1983 | Emerson | |
| 4,778,730 | A | 10/1988 | Zucker | |
| 4,998,454 | A | 3/1991 | Chaconas et al. | |
| 5,025,688 | A | 6/1991 | Davis | |
| 5,237,893 | A | 8/1993 | Ryder et al. | |
| D340,633 | S | 10/1993 | Badiali | |
| 5,259,277 | A | 11/1993 | Zurbuchen | |
| 5,259,279 | A | 11/1993 | Strauch | |
| 5,259,280 | A | 11/1993 | Hoy | |
| 5,284,075 | A | 2/1994 | Strauch et al. | |
| 5,291,811 | A | 3/1994 | Goss | |
| 5,341,707 | A | 8/1994 | Bond | |
| 5,421,224 | A | 6/1995 | Bond | |
| D360,344 | S | 7/1995 | Eggert et al. | |
| 5,461,952 | A | 10/1995 | Goss | |
| D375,669 | S | 11/1996 | Shiao | |
| D378,186 | S | 2/1997 | Braun | |
| 5,601,003 | A | 2/1997 | Amtenbrink et al. | |
| D379,750 | S | 6/1997 | Thompson et al. | |
| D383,660 | S | 9/1997 | Anderson | |
| D393,582 | S | 4/1998 | Amtenbrink et al. | |
| D398,507 | S | 9/1998 | Thompson et al. | |
| D398,508 | S | 9/1998 | Thompson et al. | |
| D402,179 | S | 12/1998 | Scott | |
| 5,868,047 | A | 2/1999 | Faust | |
| D408,253 | S | 4/1999 | Rowlay | |
| D411,428 | S | 6/1999 | Scott | |
| D414,095 | S | 9/1999 | Hoepfl et al. | |
| D415,007 | S | 10/1999 | Jimenez et al. | |
| 5,964,009 | A | 10/1999 | Hoepfl et al. | |
| 6,019,022 | A | 2/2000 | Dotson | |
| D427,877 | S | 7/2000 | Rowlay et al. | |
| 6,228,306 | B1 | 5/2001 | Hoepfl et al. | |
| D447,678 | S | 9/2001 | Staton et al. | |
| 6,295,903 | B1 | 10/2001 | Tipper et al. | |
| 6,368,536 | B1 | 4/2002 | Hoepfl et al. | |
| 6,397,710 | B1 | 6/2002 | Baker | |
| D467,486 | S | 12/2002 | Mathieu et al. | |
| D468,182 | S | 1/2003 | Thompson et al. | |
| 6,520,055 | B1 | 2/2003 | Reusch et al. | |
| D481,290 | S | 10/2003 | Thompson et al. | |
| D487,690 | S | 3/2004 | Hu | |
| 6,883,405 | B2 | 4/2005 | Strauch | |
| D523,315 | S | 6/2006 | Kienzler | |
| 7,065,883 | B2 | 6/2006 | Popeil et al. | |
| D542,620 | S | 5/2007 | Thompson et al. | |
| D553,464 | S | 10/2007 | Rinner | |
| 7,325,469 | B1 | 2/2008 | Clampitt, Jr. et al. | |
| 7,395,602 | B2 | 7/2008 | Backus et al. | |
| D575,132 | S | 8/2008 | Panier | |
| 7,814,815 | B2 | 10/2010 | Chen | |
| RE42,278 | E | 4/2011 | Kienzler | |
| 8,136,430 | B2 | 3/2012 | Hu | |
| 8,166,851 | B2 | 5/2012 | Pchola et al. | |
| D682,067 | S | 5/2013 | Tillet | |
| D691,015 | S | 10/2013 | Hyma et al. | |
| D694,608 | S | 12/2013 | Nelson et al. | |
| 8,701,524 | B2 | 4/2014 | Chang et al. | |
| 8,870,078 | B2 | 10/2014 | Webb et al. | |
| D716,629 | S | 11/2014 | Suter | |
| 8,973,474 | B2 | 3/2015 | Lai | |
| 9,144,891 | B2 * | 9/2015 | Khangar | B25G 1/043 |
| D753,978 | S | 4/2016 | Ranieri | |
| 9,314,907 | B2 | 4/2016 | Wang | |
| D774,867 | S | 12/2016 | Panier | |
| D778,703 | S | 2/2017 | Nelson | |
| D800,528 | S | 10/2017 | Leibowitz | |
| D829,524 | S | 10/2018 | Su | |
| D840,207 | S | 2/2019 | Sun et al. | |
| 2003/0196527 | A1 | 10/2003 | Strauch | |
| 2004/0006876 | A1 | 1/2004 | Popeil et al. | |
| 2004/0099106 | A1 | 5/2004 | Strauch et al. | |
| 2004/0139832 | A1 * | 7/2004 | Hu | B25G 1/046 81/177.4 |
| 2004/0200079 | A1 | 10/2004 | Stoughton | |
| 2005/0076749 | A1 | 4/2005 | Liu et al. | |
| 2007/0051215 | A1 | 3/2007 | Petillo | |
| 2008/0066589 | A1 | 3/2008 | Tseng | |
| 2008/0127473 | A1 | 6/2008 | Yu | |
| 2008/0265594 | A1 | 10/2008 | Popeil et al. | |
| 2008/0276770 | A1 | 11/2008 | Blum et al. | |
| 2009/0165604 | A1 | 7/2009 | Macor | |
| 2010/0288086 | A1 | 11/2010 | Huang | |
| 2012/0285301 | A1 | 11/2012 | Totsu | |
| 2013/0200159 | A1 | 8/2013 | Webb et al. | |
| 2014/0325816 | A1 | 11/2014 | Ng et al. | |
| 2016/0129581 | A1 | 5/2016 | Lee et al. | |
| 2018/0161972 | A1 * | 6/2018 | Hsiao | B25B 15/008 |

FOREIGN PATENT DOCUMENTS

| | | |
|---|---|---|
| CN | 201544179 | 8/2010 |
| CN | 202399186 | 8/2012 |
| CN | 103737529 | 4/2014 |
| CN | 303336007 | 8/2015 |
| CN | 105291018 | 2/2016 |
| CN | 205703936 | 11/2016 |
| DE | 8519877 | 10/1985 |
| DE | 3515835 | 10/1986 |
| DE | 4029734 | 3/1992 |
| DE | 9303706 | 5/1993 |
| DE | 9400780 | 3/1994 |
| DE | 29703215 | 6/1998 |
| DE | 29820168 | 1/1999 |
| DE | 19720139 | 3/1999 |
| DE | 20017964 | 2/2002 |
| DE | 20203297 | 7/2002 |
| DE | 10234205 | 2/2003 |
| DE | 20316555 | 2/2003 |
| DE | 20117855 | 3/2003 |
| DE | 10204570 | 9/2003 |
| DE | 10209034 | 9/2003 |
| DE | 202011051984 | 11/2011 |
| DE | 202012102262 | 7/2012 |
| EP | 608711 | 8/1994 |
| EP | 1422027 | 5/2004 |
| ES | 2343666 | 8/2010 |
| FR | 685851 | 7/1930 |
| FR | 1325282 | 4/1963 |
| FR | 1396783 | 4/1965 |
| GB | 342438 | 2/1931 |
| GB | 1296731 | 11/1972 |
| GB | 2063743 | 6/1981 |
| GB | 2321868 | 8/1998 |
| NL | 7407268 | 12/1975 |
| TW | 551876 | 9/2003 |
| TW | D103108 | 2/2005 |
| TW | D111513 | 6/2006 |
| TW | M367782 | 11/2009 |
| TW | M468385 | 12/2013 |
| WO | WO9004498 | 5/1990 |
| WO | WO9414576 | 7/1994 |
| WO | WO2010040878 | 4/2010 |

* cited by examiner

SCREWDRIVER

CROSS-REFERENCE TO RELATED PATENT APPLICATION

This application is a continuation of U.S. application Ser. No. 15/980,802, filed on May 16, 2018 which claims priority to U.S. Provisional Patent Application No. 62/507,314, filed on May 17, 2017, the entire content of each of which are incorporated herein by reference. This application also claims priority to U.S. Provisional Patent Application No. 62/509,241, filed on May 22, 2017, the entire content of which is incorporated herein by reference.

FIELD OF THE INVENTION

The present invention relates to screwdrivers, and more particularly to indicators on screwdrivers.

SUMMARY OF THE INVENTION

The present invention provides, in one aspect, a screwdriver comprising a handle including a butt and a shank extending from the handle and including a tip. The butt includes a first indicating element having a shape corresponding to the tip and a plurality of second indicating elements arranged around the first indicating element. Each of the second indicating elements has the shape.

The present invention provides, in another aspect, a screwdriver comprising a handle formed from a first material and a second material that is different than the first material. The handle includes a butt. The screwdriver further comprises a shank extending from the handle and including a tip. The butt includes a first indicating element arranged on the first material and having a shape corresponding to the tip and a plurality of second indicating elements arranged on the second material and around the first indicating element. Each of the second indicating elements has the shape.

The present invention provides, in yet another aspect, a screwdriver assembly comprising a first screwdriver including a first handle having a first butt and a first shank extending from the first handle and including a first tip. The screwdriver assembly further comprises a second screwdriver including a second handle having a second butt and a second shank extending from the second handle and including a second tip. The first butt includes a first indicating element having a first shape corresponding to the first tip and a plurality of second indicating elements arranged around the first indicating element. Each of the second indicating elements has the first shape. The second butt includes a third indicating element having a second shape corresponding to the second tip and a plurality of fourth indicating elements arranged around the third indicating element. Each of the fourth indicating elements has the second shape. The first tip has a different shape than the second tip and the second shape is different than the first shape.

Other features and aspects of the invention will become apparent by consideration of the following detailed description and accompanying drawings.

Figure 1:
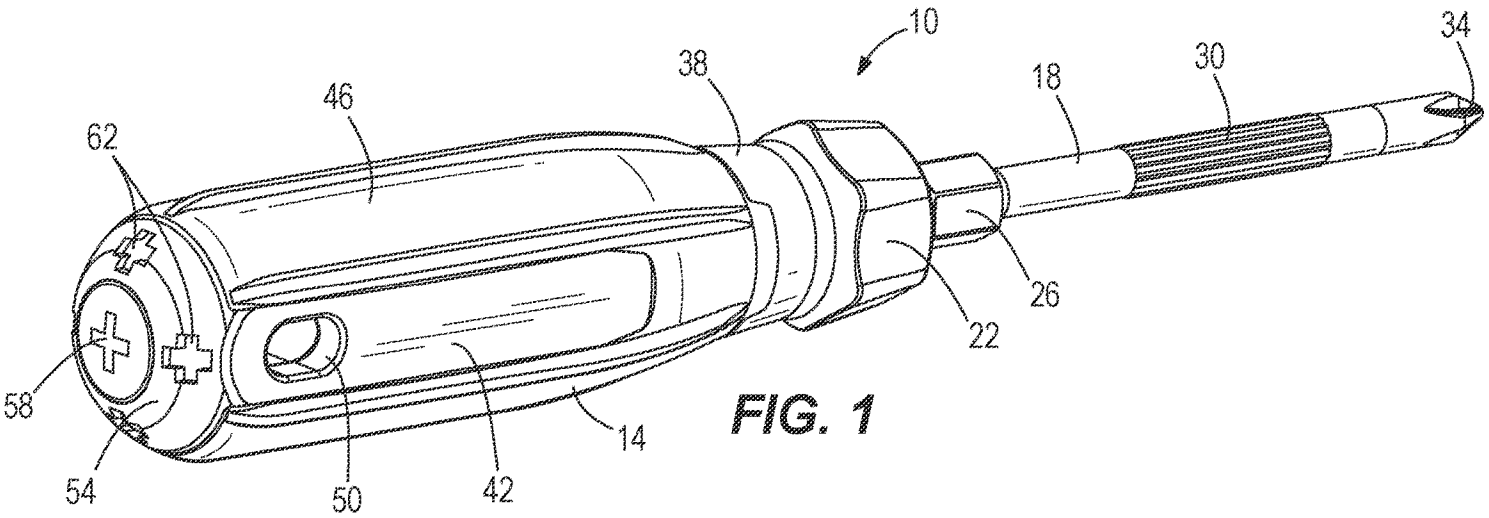
FIG. 1 is a perspective view of a screwdriver in accordance with an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

A screwdriver 10 includes a handle 14, a shank 18, and a neck 22 in between the handle 14 and the shank 18. In some embodiments, the neck 22 is omitted from the screwdriver 10. The shank 18 includes a hex bolster 26, such that a wrench may be used to manipulate and rotate the screwdriver 10 via the hex bolster 26. Knurling 30 is provided on a portion of the shank 18 and a tip 34 is provided on the end of the shank 18 opposite the handle.

Figure 16:
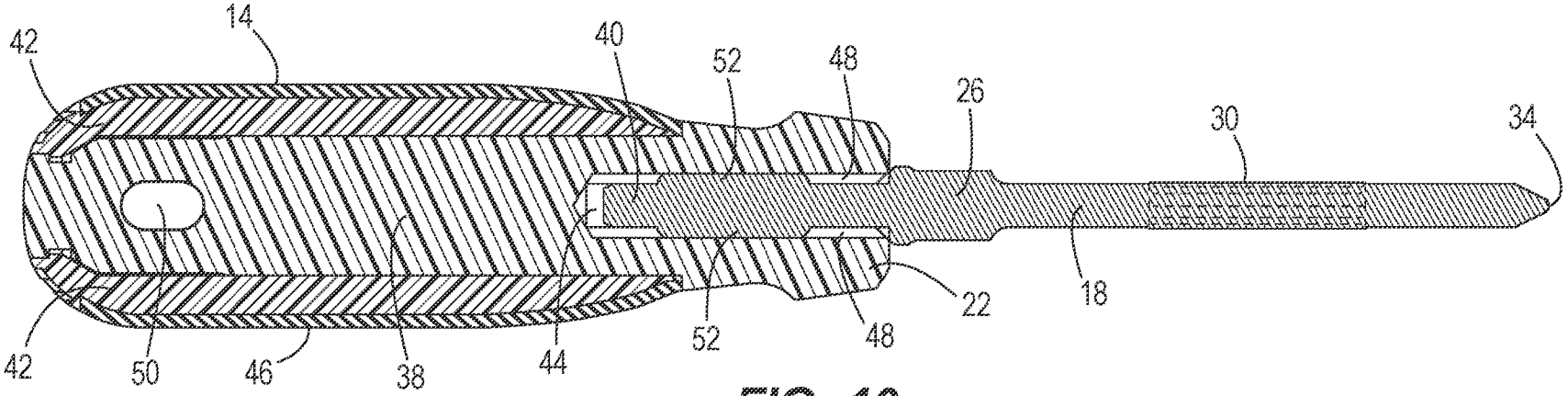
FIG. 16 is a cross-sectional view of the screwdriver of FIG. 1.
Figure 17:
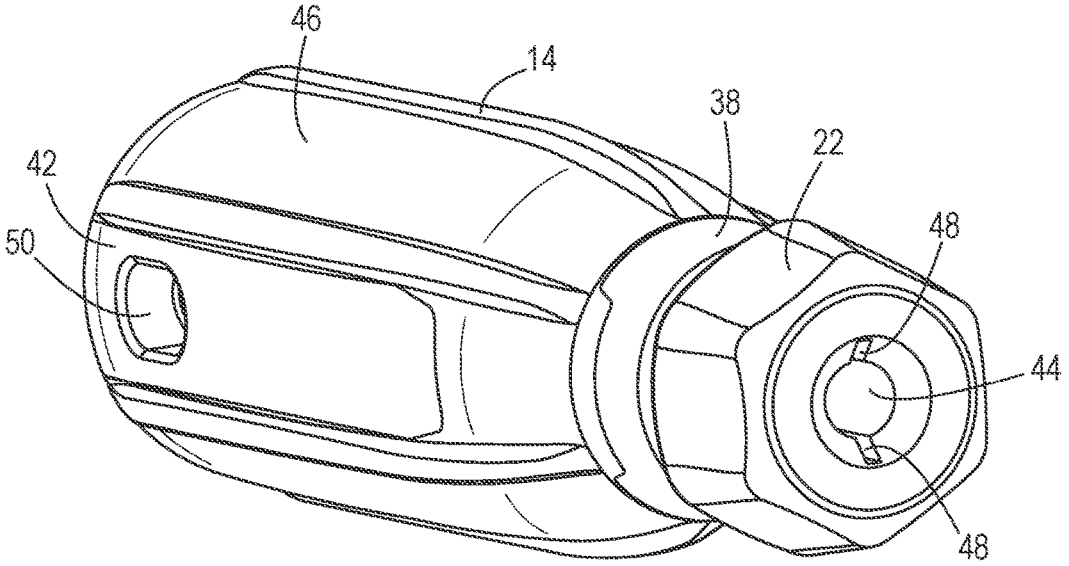
FIG. 17 is a perspective view of the screwdriver of FIG. 1 with a shank removed.
Figure 18:
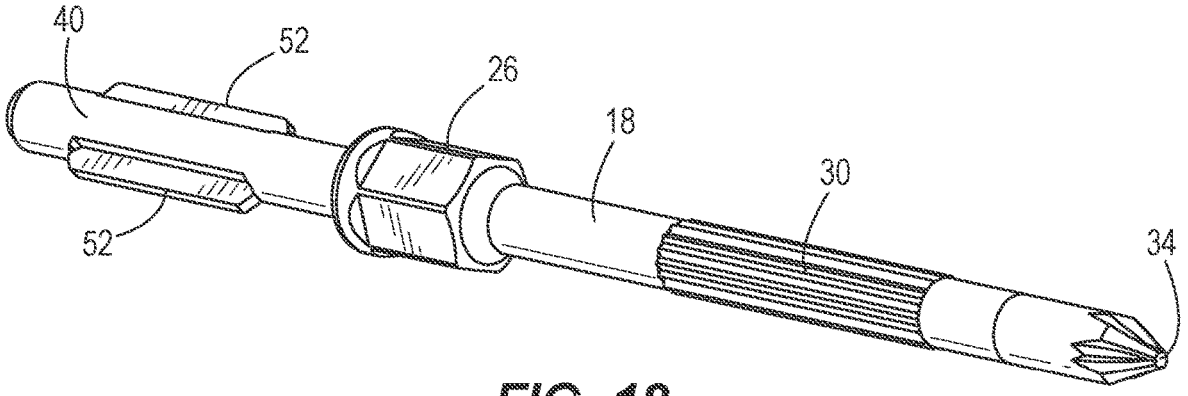
FIG. 18 is a perspective view of a shank of the screwdriver of FIG. 1.

The handle 14 may be made of multiple materials. In the illustrated embodiment, the handle has a core plastic material 38, which also forms neck 22. As shown in FIG. 16, the shank 18 is formed from metal and to assembly the screwdriver 10, a rear portion 40 of the shank 18 is set into an annular bore 44 that begins at the neck 22 and is longitudinally defined within the core plastic material 38. In alternative embodiments, the bore 44 is omitted and the shank 18 is simply insert molded into the core plastic material 38. As shown in FIG. 17, two grooves 48 arranged opposite each other extend radially outward from the annular profile of the bore 44 along at least a portion of the length of the bore 44. As shown in FIG. 18, two splines 52 extend radially outward from the rear portion 40 of the shank 18. The splines 52 are arranged within the grooves 48 when the rear portion of the shank 40 is arranged within the bore 44. A hard plastic material 42 is provided around the core plastic material 38 and a rubber overmold material 46 is provided over the hard plastic material 42. A recess 50 is defined in the handle 14 for attachment to a lanyard or a tool belt. In the illustrated embodiment, the recess 50 extends through the hard plastic material 42 and the core plastic material 38.

Figure 3:
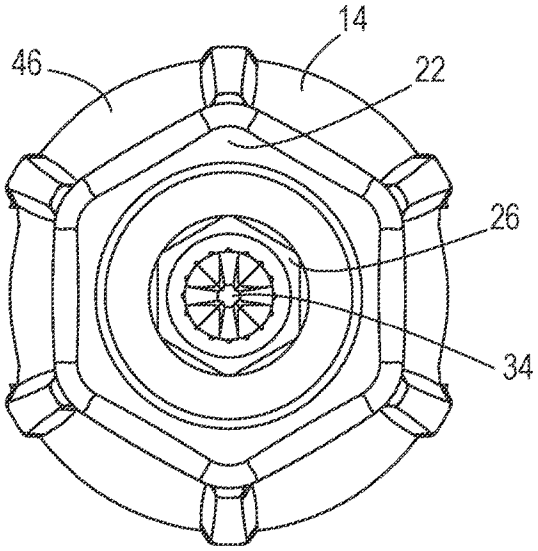
FIG. 3 is a front plan view of the screwdriver of FIG. 1.
Figure 2:
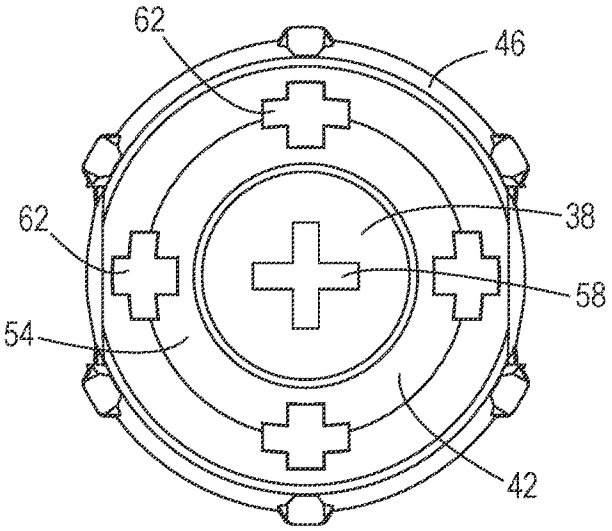
FIG. 2 is a rear plan view of the screwdriver of FIG. 1.

On the side of the handle 14 opposite the shank 18 the handle 14 has a butt 54. The butt 54 includes a first indicating element 58 having a shape corresponding to the tip 34. For instance, as shown in FIGS. 1 and 2, the first indicating element 58 has the shape of a cross. The cross shape corresponds to the tip 34 because the screwdriver 10 of FIGS. 1-3 is a Philips head screwdriver, and thus has a cross-shaped tip 34, as shown in FIG. 3. As shown in FIGS. 1 and 2, the butt 54 also includes a plurality of second indicating elements 62 arranged around the first indicating element 58. Also, in the illustrated embodiment, the second indicating elements 62 are arranged around the first indicating element 58 in an annular arrangement. However, in other embodiments, the second indicating elements 62 could be arranged around the first indicating element 58 in other arrangements or patterns, such as polygonal arrangements.

The second indicating elements 62 have the same shape as the first indicating element 58. In the illustrated embodiment, the first indicating element 58 has a first size that is slightly larger than a second size of the second indicating elements 62. However, in other embodiments, the first indicating element 58 may be the same size as the second indicating elements 62. In the illustrated embodiment, the first indicating element 58 is located on the core plastic material 38 portion of the butt 54 and the second indicating elements 62 are located on the hard plastic material 42 portion of the butt 54. However, in other embodiments, the first indicating element 58 and the second indicating elements 62 may be located on the same material portion of the butt 54.

In the illustrated embodiment, the first indicating element 58 is recessed into the butt 54 and the second indicating elements 62 are also recessed into the butt 54. However, in other embodiments, the first indicating element 58 may be a protrusion formed on the butt and the second indicating elements 62 may also be protrusions formed on the butt 54. In still other embodiments, the first indicating element 58 may be a protrusion and the second indicating elements 62 recessed, or the first indicating element 58 may be recessed and the second indicating elements 62 may be protrusions.

Figure 4:
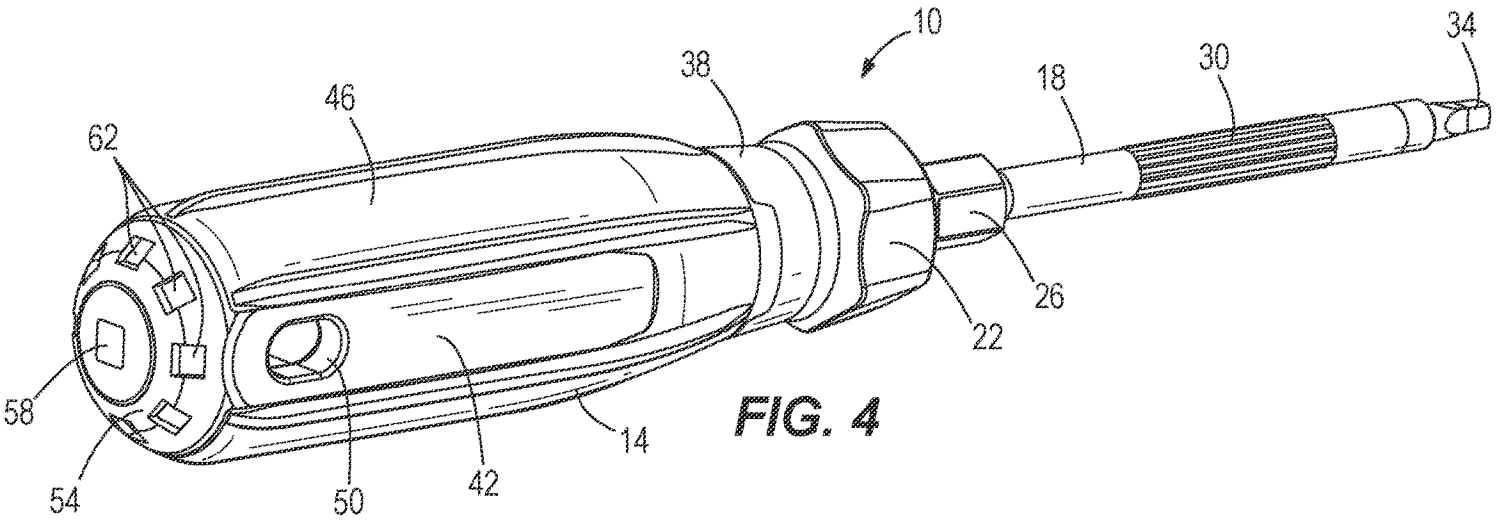
FIG. 4 is a perspective view of another screwdriver in accordance with an embodiment of the invention.
Figure 6:
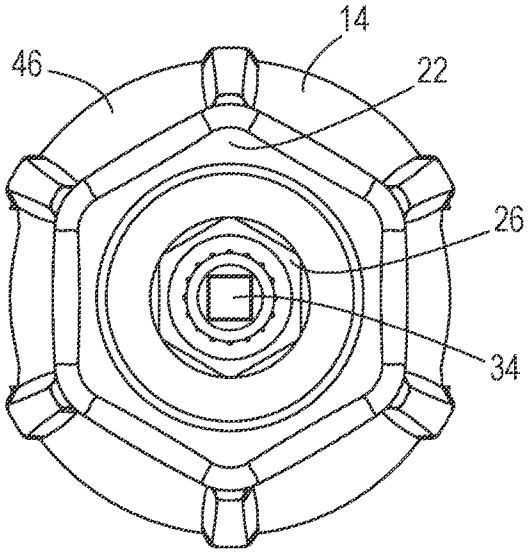
FIG. 6 is a front plan view of the screwdriver of FIG. 4.
Figure 5:
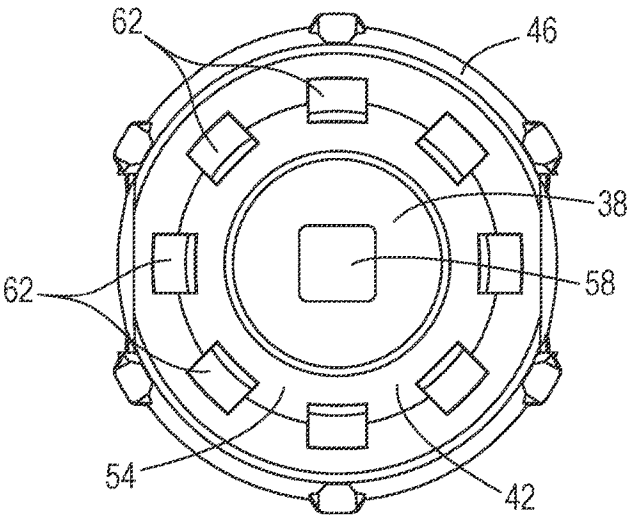
FIG. 5 is rear plan view of the screwdriver of FIG. 4.
Figure 7:
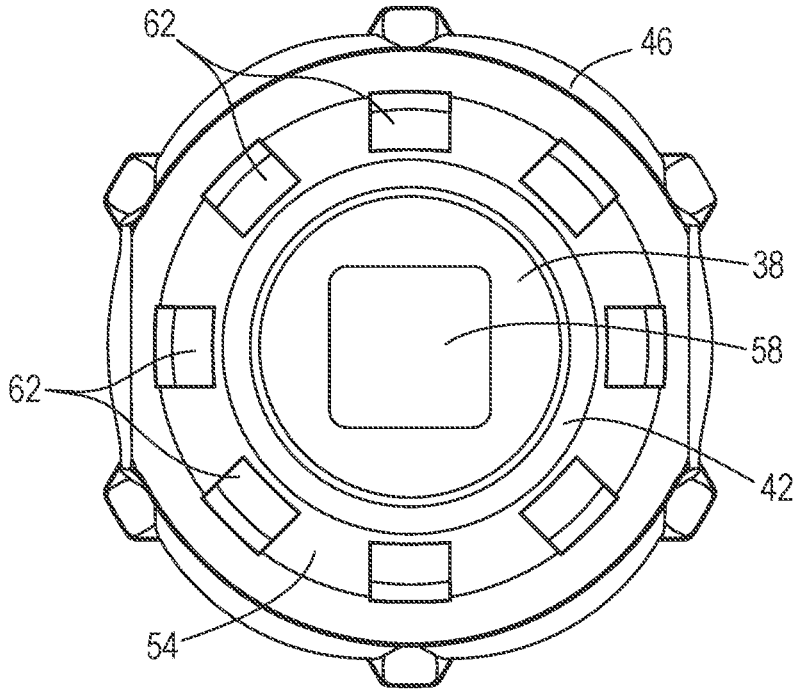
FIG. 7 is a rear plan view of another screwdriver in accordance with an embodiment of the invention.

As shown in FIGS. 4-6, a square screwdriver 10 is illustrated. The square drive screwdriver 10 is identical to the Phillips head screwdriver 10 of FIGS. 1-3 except that the tip 34, first indicating element 58, and plurality of second indicating elements 62 have a square shape, rather than a cross shape. FIG. 7 illustrates the butt 54 of another square screwdriver, except that that the first indicating element 58 is larger than the first indicating element 58 of the square screwdriver butt 54 in FIG. 5, to indicate to the operator that the screwdriver 10 of FIG. 7 has a larger square tip 34 than the screwdriver 10 of FIGS. 4-6.

Figure 8:
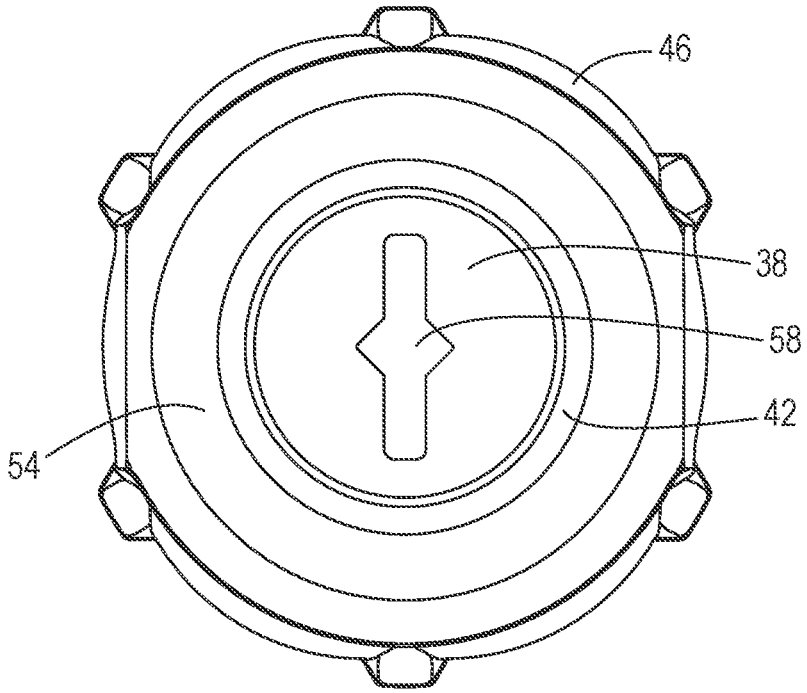
FIG. 8 is a rear plan view of another screwdriver in accordance with an embodiment of the invention.
Figure 9:
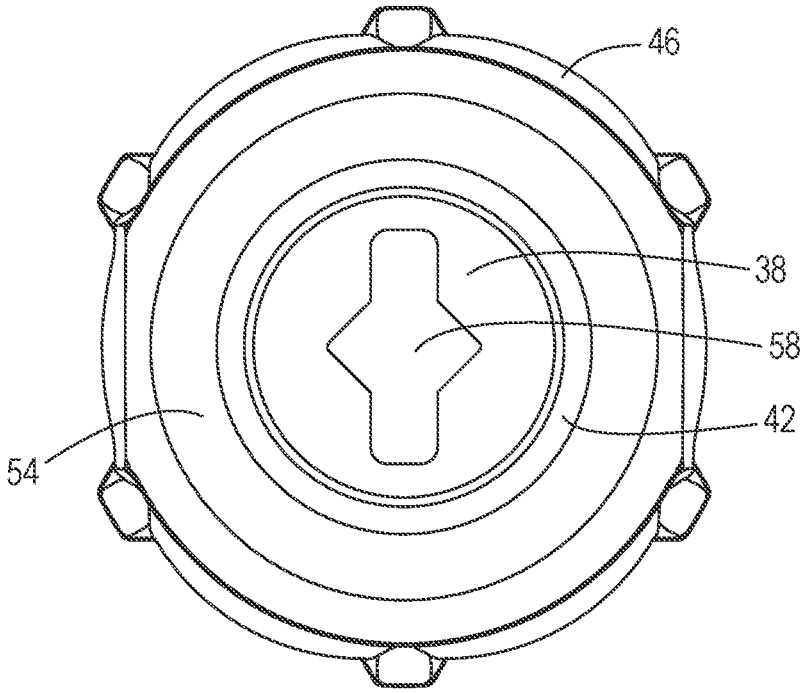
FIG. 9 is a rear plan view of another screwdriver in accordance with an embodiment of the invention.
Figure 10:
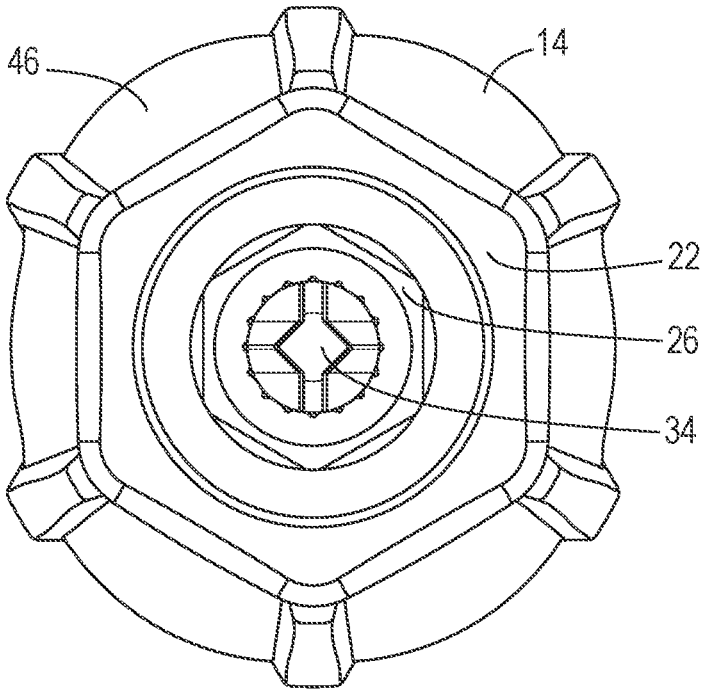
FIG. 10 is a front plan view of the screwdriver of FIG. 9.
Figure 11:
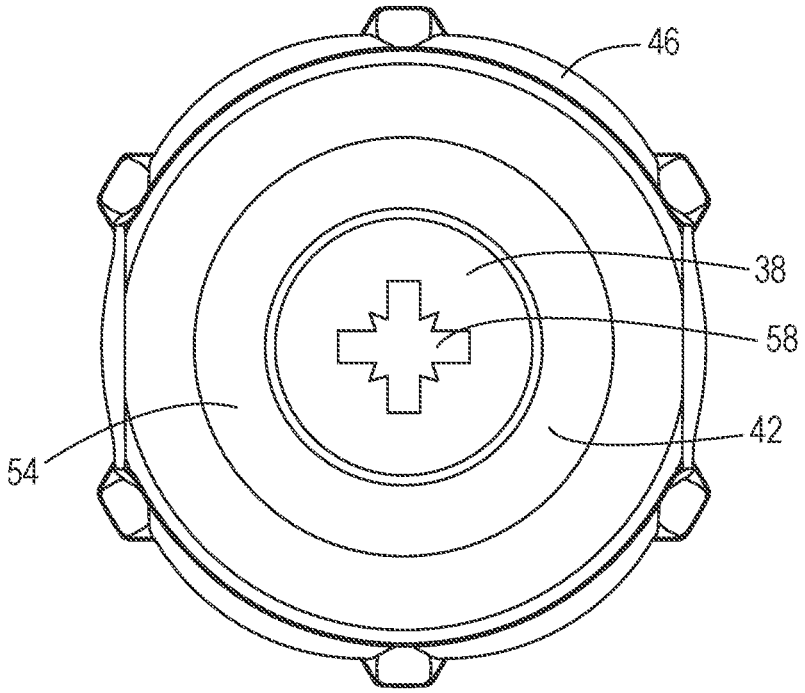
FIG. 11 is a rear plan view of another screwdriver in accordance with an embodiment of the invention.
Figure 12:
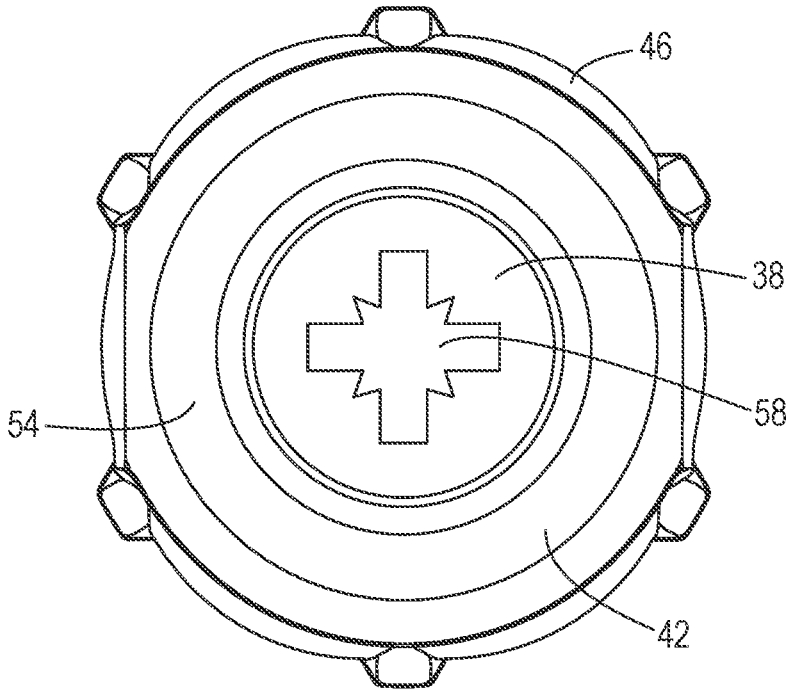
FIG. 12 is a rear plan view of another screwdriver in accordance with an embodiment of the invention.
Figure 13:
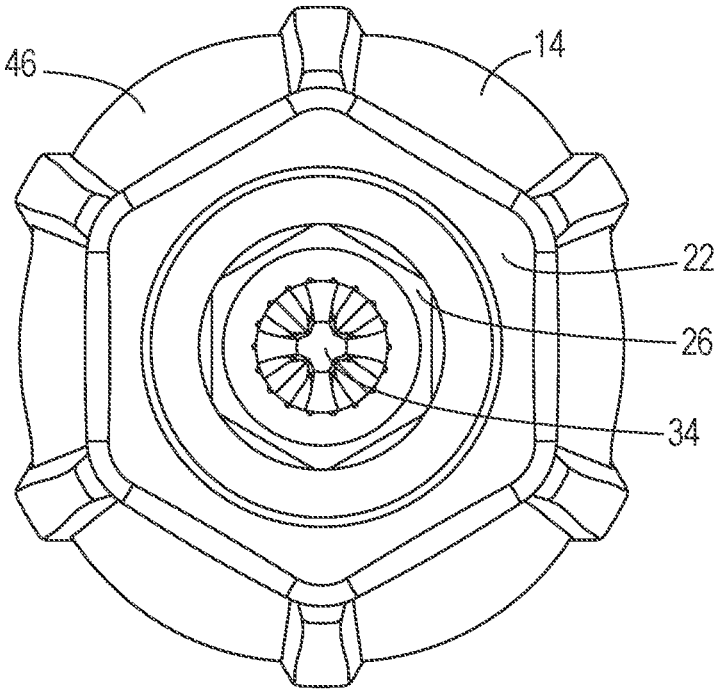
FIG. 13 is a front plan view of the screwdriver of FIG. 12.
Figure 14:
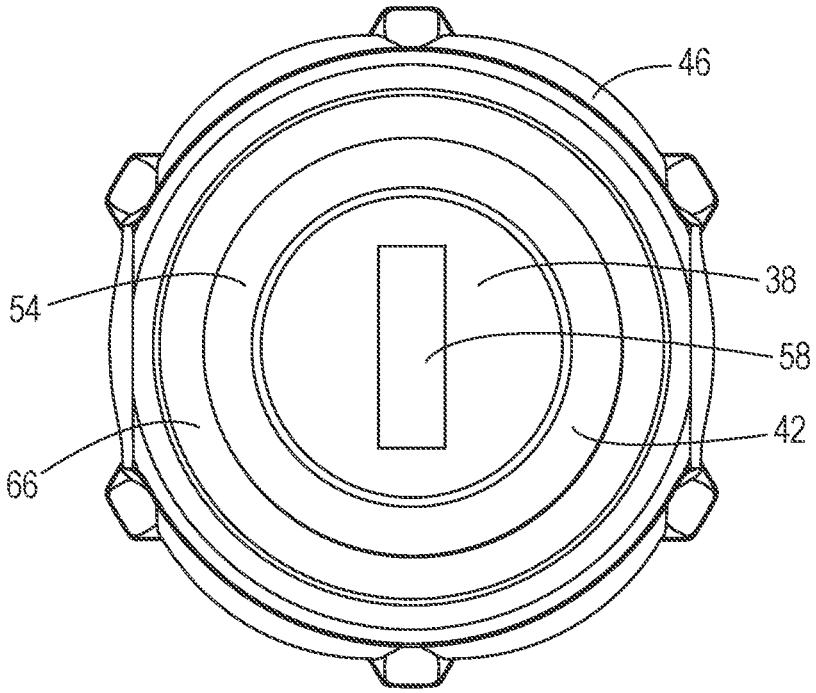
FIG. 14 is a rear plan view of another screwdriver in accordance with an embodiment of the invention.
Figure 15:
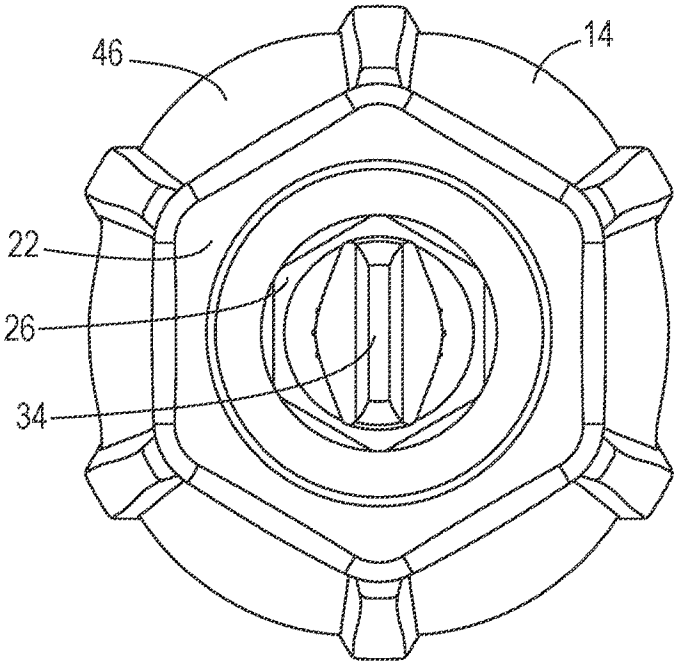
FIG. 15 is a front plan view of the screwdriver of FIG. 14.

FIGS. 8 and 9 illustrate the butts 54 of two other screwdrivers 10 with first indicating elements 58 that have a shape corresponds to the tip 34 with the shape shown in FIG. 10. FIGS. 11 and 12 illustrate the butts 54 of two Pozidriv screwdrivers 10 with first indicating elements 58 that have a shape relating to the tip 34 shown in FIG. 13. FIG. 14 illustrates the butt 54 of a flathead screwdriver 10 with a first indicating element 58 having a shape relating to the tip 34 shown in FIG. 15. In the screwdriver 10 of FIGS. 14 and 15, instead of a plurality of second indicating elements 62, there is an annular recess 66 surrounding the first indicating element 58 on the butt 54.

Regardless of what size, shape, or pattern the first and second indicating elements 58, 62 are arranged in, and regardless of whether the first and second indicating elements 58, 62 are recessed or formed as protrusions on the butt 54, the first and second indicating elements 58, 62 are tactile indications for the operator representing the type of screwdriver IO being utilized. An operator need only reach down and feel the butt 54 of the screwdriver TO, by pressing fingers against the first and/or second indicating elements 58, 62, to identify the type of screwdriver 10 and the tip 34 it utilizes.

Various features of the invention are set forth in the following claims.

What is claimed is:

1. A screwdriver comprising:

a handle comprising:

a first end;

a second end, the second end including an end surface;

a shank extending between the first end of the handle and a tip;

wherein the end surface includes a first recess having an edge defining an outline corresponding to the tip and a plurality of second recesses arranged around the first recess; and wherein each of the second recesses has an edge defining an outline;

wherein the outline of the second recesses is smaller than the outline of the first recess.

2. The screwdriver of claim 1, wherein the end surface is a curved surface and wherein the end surface is concave relative to the second end of the handle.

3. The screwdriver of claim 1, wherein the handle is formed from a first material and from a second material that is different from the first material.

4. The screwdriver of claim 3, wherein the end surface includes a first portion formed from the first material and a second portion formed from the second material.

5. The screwdriver of claim 4, wherein the first recess is located on the first portion of the end surface and the second recesses are located on the second portion of the end surface.

6. The screwdriver of claim 1, wherein the first recess has a first cross-shaped outline and the second recesses each have a second cross-shaped outline.

7. The screwdriver of claim 1, the handle further comprising a hole extending through the handle such that a lanyard can extend through the handle.

8. The screwdriver of claim 1, the shank further comprising a hex bolster such that a tool may be used to rotate the screwdriver via the hex bolster.

9. A screwdriver comprising:

a handle formed from a first material and a second material that is different than the first material, the handle including an end surface; and a shank extending from a first end of the handle opposite the end surface and including a tip;

wherein the end surface includes a first element located in the first material and having a perimeter shape corresponding to the tip and a plurality of second elements located in the second material and spaced around the first element;

wherein the first element has a first perimeter length and each of the second elements have a second perimeter length that is different than the first perimeter length;

wherein the first element is one of a recess and a protrusion and wherein the plurality of second elements are protrusions.

10. The screwdriver of claim 9, wherein the first perimeter length is greater than the second perimeter length.

11. The screwdriver of claim 9, wherein the second elements each have the perimeter shape corresponding to the tip.

12. The screwdriver of claim 9, wherein the first element is located at a center of the end surface.

13. The screwdriver of claim 12, wherein the plurality of second elements are arranged around the first element in an annular arrangement.

14. The screwdriver of claim 9, further comprising a neck formed of the first material.

15. A screwdriver assembly comprising:

a first screwdriver including:

a first handle including a first end and a second end, the second end including a first end surface;

a first shank extending between the first end of the first handle and a first tip; and a second screwdriver including:

a second handle including a first end and a second end, the second end including a second end surface;

a second shank extending between the first end of the second handle and a second tip;

wherein the first end surface includes a first element having a first shape corresponding to the first tip and a plurality of second elements spaced around the first element and wherein the first element has a first size that is different than a second size of each of the second elements;

wherein the second end surface includes a third element having a second shape corresponding to the second tip and a plurality of fourth elements spaced around the third elements and wherein the third element has a third size that is different than a fourth size of each of the fourth elements;

wherein the first element is one of a recess and a protrusion and wherein the plurality of second elements are protrusions; and wherein the third element is one of a recess and a protrusion and wherein the plurality of fourth elements are protrusions.

16. The screwdriver assembly of claim 15, wherein each of the second elements has the first shape and each of the fourth elements has the second shape.

17. The screwdriver assembly of claim 15, wherein the first tip has a different shape than the second tip.

18. The screwdriver assembly of claim 15, wherein the first end surface includes a first portion and a second portion and the second end surface includes a third portion and a fourth portion.

19. The screwdriver assembly of claim 18, wherein the first portion is formed from a first material and the second portion is formed from a second material and wherein the third portion is formed from the first material and the fourth portion if formed from the second material.

* * * * *